United States Patent [19]

Mohler

[11] 4,108,247

[45] Aug. 22, 1978

[54] FIRE SPRINKLER HEAD

[76] Inventor: Johann Georg Mohler, Laugneri, Weggis, Switzerland, CH 6353

[21] Appl. No.: 762,557

[22] Filed: Jan. 25, 1977

[30] Foreign Application Priority Data

Jan. 30, 1976 [CH] Switzerland ..... 1162/76

[51] Int. Cl.[2] ..... A62C 37/14

[52] U.S. Cl. ..... 169/38

[58] Field of Search ..... 169/37–42

[56] References Cited

U.S. PATENT DOCUMENTS

| | | | |
|---|---|---|---|
| 467,970 | 2/1892 | Hall | 169/40 |
| 590,978 | 10/1897 | Gschwind | 169/41 |
| 758,522 | 4/1904 | Garrett | 169/39 |
| 777,783 | 12/1904 | Garrett | 169/39 |
| 793,821 | 7/1905 | Cass, Jr. | 169/40 |

FOREIGN PATENT DOCUMENTS

| | | | |
|---|---|---|---|
| 2,428,446 | 1/1975 | Fed. Rep. of Germany | 169/37 |

*Primary Examiner*—John J. Love
*Assistant Examiner*—Andres Kashnikow
*Attorney, Agent, or Firm*—Ladas, Parry, Von Gehr, Goldsmith & Deschamps

[57] ABSTRACT

The sprinkler head includes a nozzle head and a deflector plate held a certain distance apart. Firmly gripped between these two are a closure element which seals off the nozzle orifice and a trigger element (e.g. a liquid-filled glass vessel or a fusible soldered link) which disintegrates under the action of heat. When the trigger element disintegrates, the closure element is no longer held over the nozzle orifice but is forced away by the pressure of the water in the supply line. A spring element acting on the closure element guides it to one side clear of the jet of water now emerging through the nozzle orifice. The closure element cannot therefore become lodged in the sprinkler head to obstruct the water jet and thus impair the water distributing function of the sprinkler head.

3 Claims, 10 Drawing Figures

Figure 1:
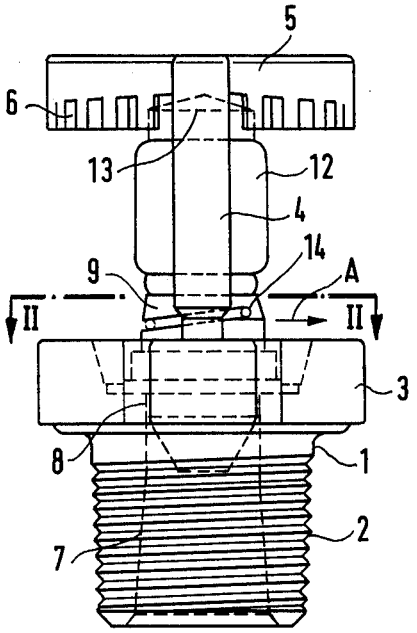

Fig. 5
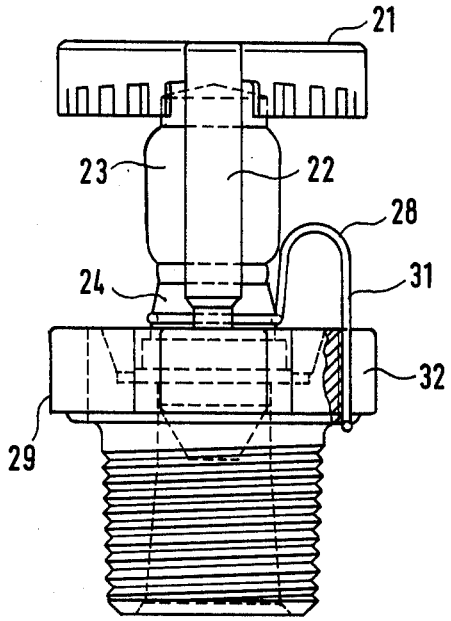
Fig. 6(a)
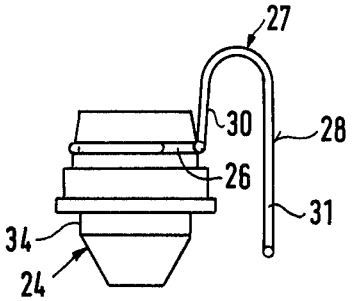
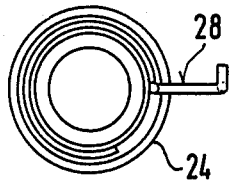
Fig. 6(b)
Fig. 8
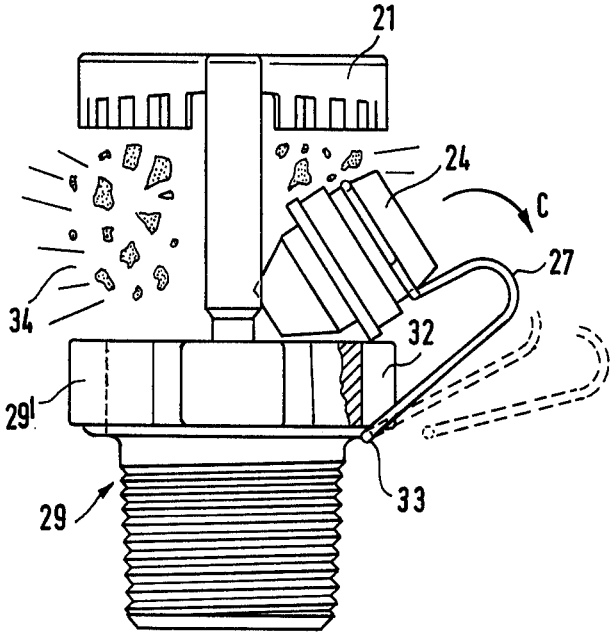
Fig. 7(a)
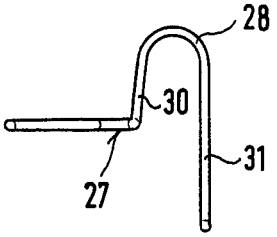
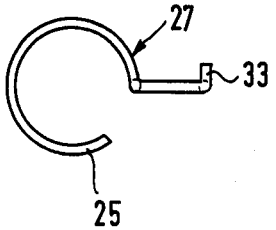
Fig. 7(b)

FIRE SPRINKLER HEAD

The present invention relates to a fire sprinkler head mountable in a standing, suspended or horizontal position and including a nozzle head; a deflector plate connected to the nozzle head by at least two support elements fastened to the edge of the deflector plate; and means which block the mouth of the nozzle when the sprinkler head is in its state of readiness, said means consisting of a closure element seated sealingly over the mouth of the nozzle and a trigger element which exerts a closing force on the closure element, such that actuation of the trigger element removes the closing force on the closure element which then moves clear of the nozzle mouth to allow a jet of water to emerge.

Sprinkler heads of this kind are brought into operation when the heat-sensitive trigger element (a glass vessel or a fusible soldered link) gripped between the nozzle orifice and the deflector plate bursts or melts under the action of heat. When the trigger element disintegrates, the pressure on the closure element, which in the state of readiness of the sprinkler head seals the nozzle orifice, is removed and the pressure of the water in the sprinkler head supply line normally forces the closure element, any trigger element mounting and holding means and the components or fragments of the trigger element clear of the region between the nozzle orifice and the deflector plate. Owing to the usually high pressure in the water supply line, the speed with which the closure member is lifted away from the nozzle orifice is relatively high. The danger therefore exists that the closure element and/or parts of the trigger element and its holder lodge in the jet distributing means of the deflector plate under the influence of the force of the water jet emerging from the nozzle. This impairs the jet distributing function of the deflector plate and reduces the effectiveness of the sprinkler head.

The object of the present invention is therefore to propose a sprinkler head of the kind described at the outset which excludes the possibility of one or more of the parts, gripped in the state of readiness of the sprinkler head to form a column between the nozzle orifice and the deflector plate, becoming wedged in the sprinkler head.

This object is achieved by arranging that the closure element is provided with guide means which, aided by the propulsive force of the water jet, guide the closure element clear of the region of the water jet when the closing force is removed, the guide means resting detachably against rigidly mutually connected parts of the sprinkler head when the sprinkler head is in its state of readiness.

Figure 2:
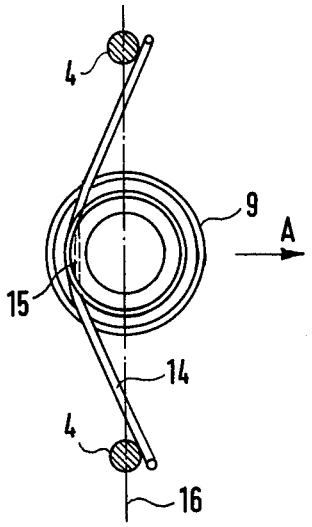
Figure 3:
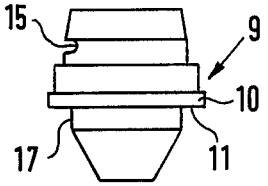
Figure 4:
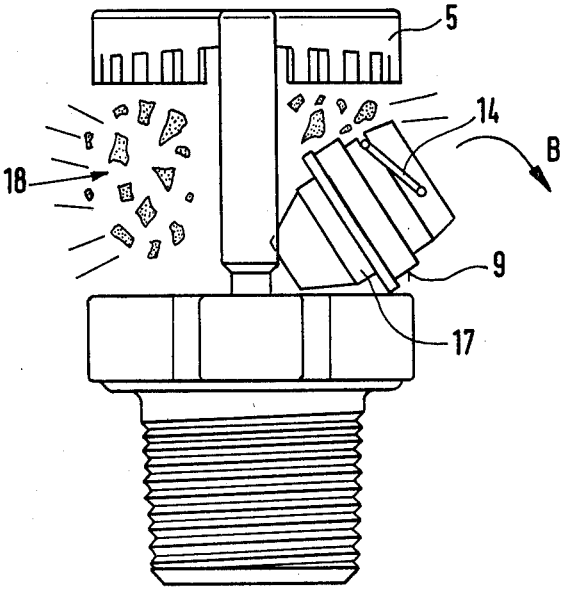

Illustratory embodiments of the invention are described below in conjunction with the drawing in which:

FIG. 1 shows a first embodiment of the sprinkler head of the invention viewed from the side, FIG. 2 is a section along line II—II in FIG. 1, several parts of the sprinkler head being omitted for the sake of clarity, FIG. 3 shows a preferred embodiment of the closure element, FIG. 4 shows the sprinkler head of FIG. 1 during the trigger phase, FIG. 5 shows a second embodiment of the sprinkler head of the invention viewed from the side, FIGS. 6*a* and 6*b* show the closure element of the sprinkler head of FIG. 5 viewed from the side (FIG. 6*a*) and from above (FIG. 6*b*) with a guide spring mounted on the closure element, FIGS. 7*a* and 7*b* show the guide spring of FIGS. 6*a* and 6*b* viewed from the side (FIG. 7*a*) and from above (FIG. 7*b*), and FIG. 8 shows the sprinkler head of FIG. 5 during the trigger phase.

In FIG. 1, the reference numeral 1 denotes as a whole a nozzle head having a thread 2 for screwing the nozzle head into a mounting (not shown). Although the nozzle head is shown in FIG. 1 standing on end, the same embodiment may be mounted horizontally or suitably suspended. Reference numeral 3 denotes a collar provided with key faces so that the nozzle head 1 can be tightened in its mounting, while 4 denotes one of two bolts which connect a deflector plate 5 to the collar 3 round the sprinkler head 1. Disposed substantially uniformly round the edge zone of the deflector plate 5 are a number of jet distributing teeth 6.

The nozzle head 1 includes an inlet bore 7, indicated by dashed lines, the downstream end of which is designed as a substantially cylindrical nozzle orifice 8 into which a closure element 9, illustrated alone in FIG. 3, is fitted so that it can easily be pushed out. The closure element 9 has a support flange 10 the underside 11 of which lies against a seat (not shown) round the rim of the nozzle orifice 8. Between this seat and the underside 11 of the support flange 10 there is a thin sealing ring (not shown) which establishes a liquid-tight seal between the closure element 9 and the nozzle orifice rim.

Gripped between the closure element 9 and the inwards facing side of the deflector plate 5 is a trigger member 12, e.g. a liquid-filled glass body. So that the trigger member 12 is held securely, its ends are precisely tapered, only the tapered portion 13 nearest the deflector plate being shown (dashed lines). Both of the tapered ends of the trigger member fit into correspondingly shaped mountings, one of which is on the inwards facing side of the deflector plate, the other on the upper end of the closure element.

When the trigger element 12 disintegrates, i.e. breaks or explodes, the pressure of the water supply ejects the closure element 9 at high speed from the nozzle orifice. There exists the danger, however, that the closure element 9 and possibly parts of the trigger element 12 lodge on the side of the deflector plate 5 exposed to the water jet or that the closure element is pressed against the deflector plate so that the water jet is not distributed in the way intended. In order that this does not happen, the sprinkler head shown in FIG. 1 is provided with a spring element 14 consisting of a length of spring wire which in its unstressed state is substantially linear. As shown in FIG. 2, the middle region of the spring element 14 fits into a groove 15 on one side of the closure element 9.

FIGS. 1 and 2 show the closure element 9 mounted in position on the nozzle head 1. The spring element, substantially straight in its unstressed state, assumes a position such that the middle of the element lies to the left of the plane 16 through the deflector plate support bolts 14 while the ends of the element lie to the right of this plane 16, resting against the periphery of the support bolts 4.

Tensioned in this way, the spring element exerts a force acting on the closure element 9 in the direction of arrow A and thus tending to move the closure element to the right.

FIG. 4 shows the effect of the spring element 14 when the trigger element 12 disintegrates (i.e. when the glass body shown in FIG. 1 explodes) thus removing the pressure holding the closure element against the nozzle orifice. The closure element 9 is ejected from the nozzle orifice by the water pressure but is then deflected to the right by the spring element 14 as soon as the cylindrical section 17 (FIGS. 3 and 4) has emerged from the nozzle orifice, and is finally flung away in the direction of arrow B by the following jet of water. Since the fragments 18 from the glass body, even from the central region of the tapered end 13 nearest the deflector plate, are practically never axially symmetrical, there is now no danger of any pieces remaining between the nozzle orifice and the deflector plate 5 to obstruct or interfere with the water jet after the trigger element 12 has disintegrated.

FIG. 5 shows a second embodiment of the sprinkler head of the invention which differs from the one described above in the type of spring element used. In this second embodiment the spring element ensures that the closure element is pivoted out of the water jet region. The deflector plate 21, the support bolts 22 (only one visible) and the trigger element 23 may be designed in exactly the same way as shown in FIG. 1. The closure element 24, shown alone in FIG. 6, is provided in its end region with a groove 26 (not visible) for receiving and holding the ring-shaped end section 25 of a spring element 27.

Integral with the ring-shaped end section 25 is a U-shaped holder 28 whose plane of flexure is perpendicular to that of the ring-shaped end section 25. The holder 28 is made of spring wire and forms a spring loop with two limbs 30, 31 of unequal length. When the spring element 27 is mounted on the closure element 9, the shorter limb 30 lies nearest the closure element and the longer limb 31 passes through a slot 32 (shown in section in FIGS. 5 and 8) in the collar 29'0 of the nozzle head 29. The longer limb 31 presses lightly against the floor of the slot 32 so that the spring element 37 shows the desired elastic qualities when the sprinkler head is brought into action. Integral with the end of the longer limb 31 is a lug 33 which juts out at right angles to the plane of flexure of the holder. In the mounted state of the spring element 37, the lug 33 lies against the underside of the collar 29' round the nozzle head 29. If the trigger element 23 disintegrates, this lug acts as a hinge pin as can be seen from FIG. 8.

As the closure element 24 is ejected from the nozzle orifice by the water pressure, it is pulled by the spring element holder 28 to the right in the direction of arrow C as soon as the cylindrical section 34 (FIG. 6*a*) has emerged from the nozzle orifice, and is flung to the side by the following jet of water. The lug 33 slips out from under the nozzle head collar 29', thus enabling the closure element to fly clear. The escape of the closure element 24 to one side out of the region of the water jet also ensures that no fragments 34 from the glass body 23 can lodge in the region of the deflector plate 21.

What I claim is:

1. A fire sprinkler head which is mountable in a standing, suspended or horizontal position and includes:

a nozzle head;

a deflector plate;

support means connecting the deflector plate to the nozzle head and including at least two support elements fastened to the edge of the deflector plate;

a closure element seated sealingly over the mouth of the nozzle, the closure element having a groove at its perphery;

a trigger element which exerts a closing force on the closure element and is actuable to remove the closing force to leave the closure element free to move clear of the nozzle mouth to allow a jet of water to emerge; and a length of spring wire which is substantially straight when in an unstressed condition and is mounted so that it lies in said groove tangentially against the periphery of the closure element and also against the perpheries of said support elements thereby to apply a biasing force to the closure element, so that when the closure force is removed and the closure element moves clear of the nozzle mouth, the spring wire, aided by the propulsive force of the water jet, urges the closure element clear of the region of the water jet.

2. A fire sprinkler head which is mountable in a standing, suspended or horizontal position and includes:

a nozzle head;

a deflector plate;

support means connecting the deflector plate to the nozzle head;

a closure element seated sealingly over the mouth of the nozzle, the closure element having a groove extending round its periphery;

a trigger element which exerts a closing force on the closure element and is actuable to remove the closing force to leave the closure element free to move clear of the nozzle mouth to allow a jet of water to emerge; and a spring element having a ring-shaped end section mounted in the groove and a U-shaped holder section, the free end of one limb the U being secured to the ring-shaped end section and the free end of the other limb of the U being pivotally mounted on the nozzle head to define a pivot point about which the closure element moves during the initial stages of the emergence of the closure element from the nozzle mouth, so that when the closure force is removed and the closure element moves clear of the nozzle mouth, the spring element causes the closure element, propelled by the force of the water jet, to move clear of the region of the water jet.

3. A sprinkler head as claimed in claim 2, wherein the spring element is made of spring wire and the nozzle head has a substantially radial slot for receiving said other limb of the U-shaped holder section and for determining the direction of motion of the closure element during the initial stages of the motion of the closure element away from the nozzle mouth.

* * * * *